US007438069B2

(12) United States Patent
Simonds

(10) Patent No.: US 7,438,069 B2
(45) Date of Patent: Oct. 21, 2008

(54) THERMOPLASTIC BOW LIMB

(75) Inventor: Gary L. Simonds, Gainesville, FL (US)

(73) Assignee: Mathew A. McPherson, Norwalk, WI (US)

( * ) Notice: Subject to any disclaimer, the term of this patent is extended or adjusted under 35 U.S.C. 154(b) by 159 days.

(21) Appl. No.: 11/335,331

(22) Filed: Jan. 19, 2006

(65) Prior Publication Data

US 2007/0163559 A1 Jul. 19, 2007

(51) Int. Cl.
*F41B 5/00* (2006.01)

(52) U.S. Cl. ..... 124/23.1

(58) Field of Classification Search ..... 124/23.1, 124/25.6, 86, 88

See application file for complete search history.

(56) References Cited

U.S. PATENT DOCUMENTS

| | | | | |
|---|---|---|---|---|
| 2,980,158 | A | 4/1961 | Meyer | 154/1 |
| 4,318,762 | A | 3/1982 | Meyer | 156/180 |
| 4,323,415 | A | 4/1982 | Meyer | 156/433 |
| 4,649,889 | A | 3/1987 | Johnston | 124/23 R |
| 4,735,667 | A | 4/1988 | Johnston | 156/175 |
| 5,269,284 | A | 12/1993 | Pujos et al. | |
| 5,501,208 | A | 3/1996 | Simonds | 124/86 |
| 5,534,213 | A | 7/1996 | Epling | 264/328.1 |
| 5,718,212 | A | 2/1998 | Allshouse et al. | 124/25.6 |
| 5,816,233 | A | 10/1998 | Andrews | 124/86 |
| 5,911,932 | A | 6/1999 | Dyksterhouse | 264/136 |
| 5,947,099 | A * | 9/1999 | Derus | 124/25.6 |
| 5,991,704 | A | 11/1999 | Rekar et al. | 702/168 |
| 6,261,500 | B1 | 7/2001 | Park et al. | 264/258 |
| 6,524,690 | B1 | 2/2003 | Dyksterhouse | 428/221 |
| 6,656,316 | B1 | 12/2003 | Dyksterhouse | 156/258 |
| 6,669,802 | B2 | 12/2003 | Andrews et al. | 156/245 |
| 2005/0229912 | A1 * | 10/2005 | Pilpel et al. | 124/86 |

* cited by examiner

*Primary Examiner*—John Ricci
(74) *Attorney, Agent, or Firm*—Vidas, Arrett & Steinkraus, PA

(57) ABSTRACT

An archery bow limb may comprise a thermoplastic material having reinforcing. A tension side of the bow limb may have continuous unidirectional reinforcing spanning substantially the entire length of the bow limb. A method of manufacturing such bow limbs may comprise building up layers of reinforcing fibers preimpregnated with thermoplastic resin (prepregs) over a core of thermoplastic material to make a preform, and compression molding the preform to consolidate the thermoplastic of the prepreg layers to one another and to the core.

10 Claims, 7 Drawing Sheets

THERMOPLASTIC BOW LIMB

BACKGROUND OF THE INVENTION

This invention relates generally to archery bows, and more specifically to archery bow limbs and methods of making same.

Current high performance archery bows generally employ bow limbs composed of composite materials, typically fiber glass and/or other reinforcement in a thermoset resin matrix. Examples of these bow limbs and materials are disclosed in U.S. Pat. Nos. 2,980,158; 4,318,762; 4,323,415; 4,649,889; 4,735,667; and 5,501,208. While these bow limbs are suitable for many of today's compound bows, the manufacturing process has a number of areas that require very close controls. Further, even with the controls, it can be difficult to produce a void free product, and considerable hand work and secondary operations are required to trim and prepare the bow limb for use.

Thermosets used in bow limbs, such as epoxy or polyester, are inherently brittle and are formed by a chemical reaction. Thus, thermosets cannot be remelted or reformed once set.

Thermoplastic materials by contrast are generally tough and can be remelted. The raw materials are generally cheaper than thermosets and have a much longer shelf life. However, the use of thermoplastics in archery bow limbs is limited.

U.S. Pat. No. 5,534,213 teaches the use of a glass filled thermoplastic material to injection mold a bow limb. These bow limbs are limited to use in bows of very minimal draw weights, for example having a maximum peak draw weight of less than 25 pounds.

There remains a need for a thermoplastic bow limb having the high strength required for use in current high performance archery bows.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, an archery bow limb comprises a body portion having a thermoplastic material and reinforcing fibers. The body portion may have a longitudinal axis and any portion of the body portion may have a component length spanning from a first edge to a second edge in a direction parallel to the longitudinal axis. A first continuous reinforcing fiber extends at least 75% of a component length of the bow limb.

In at least one other embodiment, an archery bow limb comprises a tension side layer, a core layer and a compression side layer, each layer comprising a thermoplastic material. The tension side layer further comprises a plurality of reinforcing fibers, the reinforcing fibers oriented substantially parallel to a lengthwise axis of the bow limb and continuously spanning a substantial length of the bow limb.

In at least one embodiment, a method of making an archery bow limb comprises providing a thermoplastic prepreg material and providing a core comprising thermoplastic material. A bow limb precursor is created by orienting a first layer of prepreg material over a side of the core. The bow limb precursor is then heated to consolidate the thermoplastic of the prepreg with the thermoplastic of the core.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
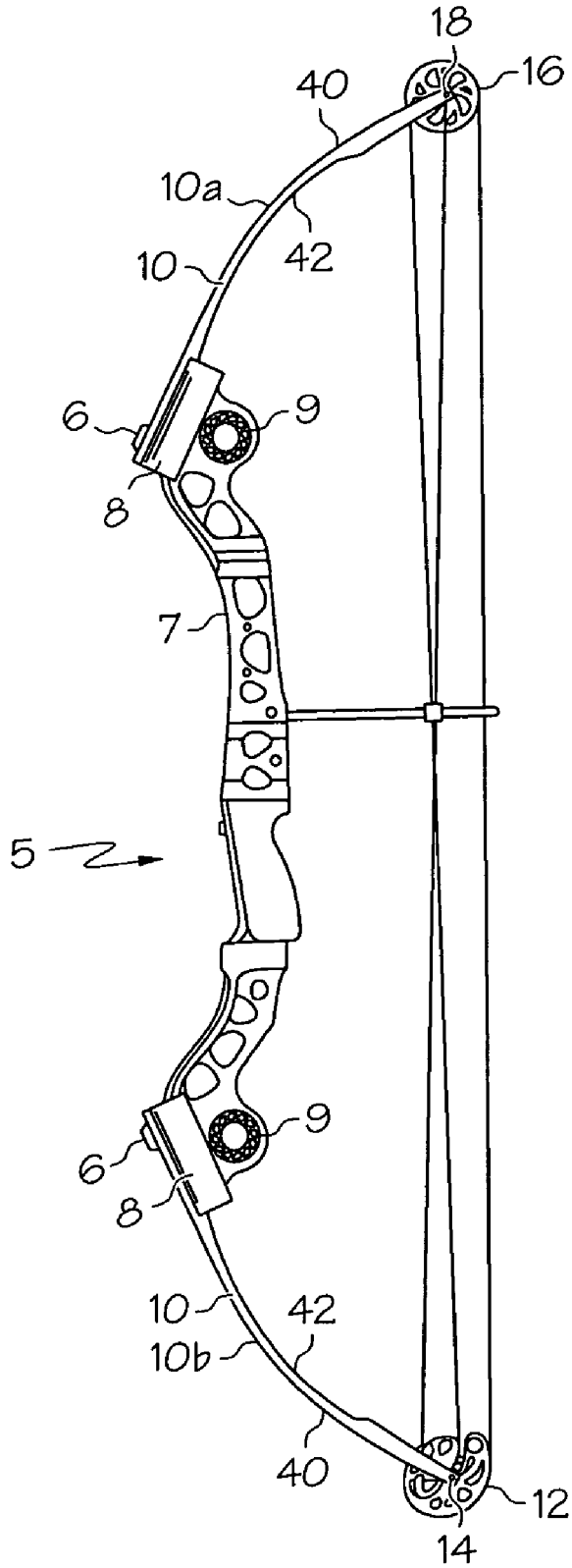
FIG. 1 shows an embodiment of an archery bow.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 5 having a bow handle 7 and bow limbs 10, including an upper limb 10*a* and a lower limb 10*b*. In some embodiments, the bow limbs 10 may comprise a composite thermoplastic material with reinforcing fibers. Each bow limb 10 may include a tension side 40 and a compression side 42. The bow limbs 10 may be attached to the bow handle 7 using any suitable attachment mechanism, such as pivotal limb mounting cups 8. In some embodiments, limb bolts 6 may pass through a bow limb 10, a portion of a mounting cup 8, and may thread into a portion of the handle 7.

The archery bow 5 may comprise a compound bow and may include a variable leverage system which allows the user to hold the bow at full draw while expending less effort than required with a traditional bow. A variable leverage device 12 may be pivotally mounted on an axle 14 at the outer end of the lower bow limb 10*b*. An idler wheel 16 may be pivotally mounted on an axle 18 at the outer end of the upper bow limb 10*a*. This particular arrangement has become known as a dual feed-out, single take-up, single cam system and was first disclosed in U.S. Pat. No. 5,368,006. The archery bow 5 may further include one or more vibration dampers 9, for example as disclosed in U.S. Pat. No. 6,257,220.

Various embodiments and methods of making bow limbs 10 comprising thermoplastic composites will be discussed herein. Bow limbs 10 may generally comprise a thermoplastic matrix material and high strength reinforcing fibers.

The thermoplastic material may comprise any thermoplastic material suitable for use in a bow limb 10, such as polyamide (PA) such as nylon 6, nylon 6,6 and nylon 11, polyphenylene sulfide (PPS), polyethylene (PE), polyether imide (PEI), polyetheretherketone (PEEK), polyethylene terephthalate (PET), polyetherketone (PEK), perfluoroalkoxy (PFA), polypropylene (PP), polymethylmethacrylate (PMMA), polyoxymethylene (POM), polybutylene terephthalate, polycarbonate, polystyrene, modified polyphenylene oxides and other suitable thermoplastics. While some embodiments may use a single thermoplastic material, various suitable mixtures may also be used.

Thermoplastic archery bow limbs may be desirable when compared to prior art composite bow limbs for reasons including, but not limited to, lower cost, greater longevity, greater toughness, greater vibration damping, the ability to be molded under heat and pressure more than once, the ability to be repaired via remolding, etc.

In some embodiments, various additives may also be used and may be mixed into the thermoplastic matrix material. Additives such as color, UV stabilizers, flow modifiers, coupling agents, effect-creating additives such as wood effect, glow-in-the-dark, etc., may be used. A bow limb 10 may further include any suitable surface finishing material, such as paint.

The reinforcing fibers may comprise any suitable material such as fiberglass, for example fiberglass of the E and S glasses, carbon, Aramid or any other suitable high strength reinforcing fibers. Desirably, the reinforcing fibers may be impregnated within the thermoplastic material of the composite bow limb 10. The reinforcing fibers may range from being very short in length to spanning the entire length of the bow limb 10. Various portions of the bow limb 10 may include reinforcing fibers of various size, shape, orientation and material.

The strength and other various desirable properties of the composite thermoplastic bow limb 10 depends upon the thermoplastic material(s) used and the size, orientation and composition of the reinforcing fibers throughout the bow limb 10.

In some embodiments, preimpregnated reinforcement fabrics and/or fibers (prepregs) may be used to form the bow limb 10. Prepreg materials may comprise ready-to-mold fibers, tape, cloth, roving, mats, sheets, filaments or other suitable reinforcing material, impregnated with a matrix composition such as a thermoplastic resin. Prepreg materials may be supplied in flat form and may be stored for later use. In some embodiments, prepregs may comprise materials disclosed in, or may be formed according to the principles disclosed in, U.S. Pat. Nos. 5,128,198, 5,911,932, 6,524,690 and 6,656,316, the disclosures of which are hereby incorporated herein by reference in their entireties.

FIGS. 2-8 show steps of an embodiment of a process for manufacturing an embodiment of a bow limb 10 comprising a thermoplastic composite.

Figure 2:
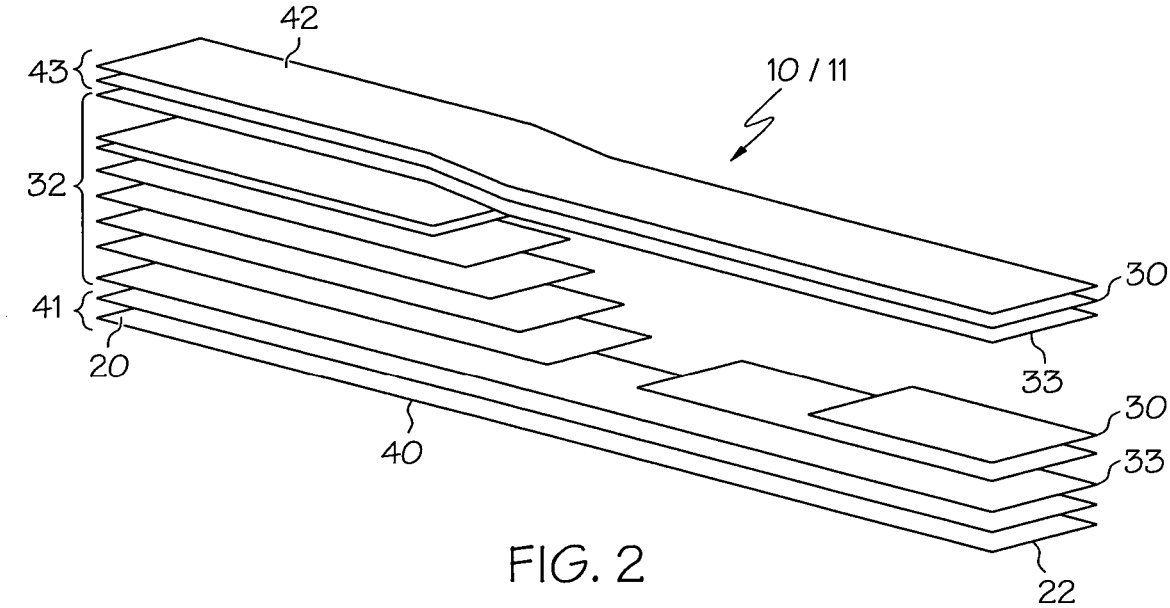
FIG. 2 shows an embodiment of an exploded view of a bow limb precursor comprising a plurality of prepreg layers.
Figure 3:
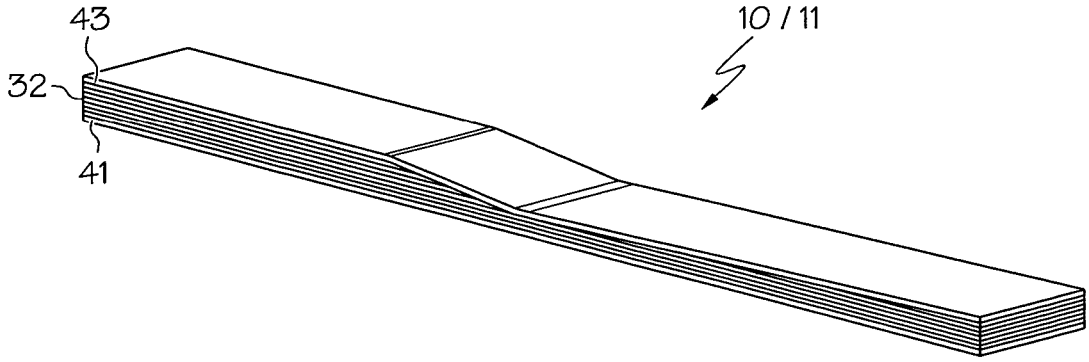
FIG. 3 shows an embodiment of a bow limb precursor.

Referring to FIGS. 2 and 3, layers 30 of thermoplastic prepreg material may be built-up to form a bow limb precursor 11. Layers 30 may include first or tension side cover layers 41, core layers 32 and second or compression side cover layers 43. For illustration purposes, a limited number of layers 30 are shown. However, each layer 30 illustrated in the drawings may comprise a plurality of layers of prepreg material.

The tension side cover layers 41 are preferably built up to a thickness of at least 0.03 inches on the tension side 40 of the bow limb 10. In order to achieve a high flexural strength in bending along the length of the bow limb 10, the reinforcing fibers in the tension side cover layer 41 prepreg material are preferably oriented unidirectionally and substantially parallel to a lengthwise axis of the bow limb 10. The reinforcing fibers may further extend continuously from one end 20 to the other end 22 of the bow limb 10. In various embodiments, it may be desirable for the unidirectional reinforcing fibers to extend continuously over at least 75%, 85%, 90%, 95%, 99% or 100% of the length of the bow limb 10. It should be noted that the final shape of the bow limb 10 may impact the percentage of the overall length of the bow limb 10 that any single reinforcing fiber is capable of spanning. In some embodiments, continuous reinforcing fibers may extend continuously over at least 75%, 85%, 90%, 95%, 99% or 100% of the length of a longitudinal component length of the bow limb 10 structure.

Figure 7:
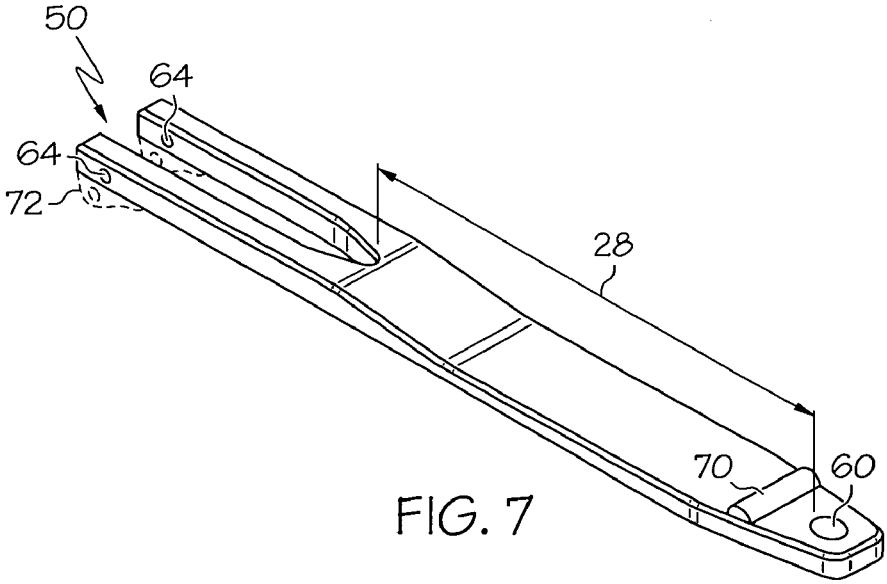

A longitudinal component length may comprise a continuous distance as measured in a direction parallel to a lengthwise axis of the bow limb 10, for example between opposing edges, sides or extremities of the bow limb 10. In some embodiments, the end of a planar surface of the bow limb 10 may comprise an edge. A longitudinal component length may be less than the overall length of the bow limb 10. For example, FIG. 7 shows an example of a longitudinal component length 28 as measured midway across the width of the bow limb 10. Due to the limb tip slot 50 and the bolt hole 60, the greatest length that a continuous reinforcing fiber may span at that location may be the longitudinal component length 28, which is less than the overall length of the bow limb 10.

In some other embodiments, the tension side cover layer 41 prepreg material may have woven, bias-ply or any other suitable reinforcing material orientation. Further, any suitable combination of layers may be used, such as alternating unidirectional layers and bias-ply layers. Reinforcing material in one layer may be oriented at any suitable angle to reinforcing material of another layer. In some embodiments, reinforcing material of a first layer may be parallel to reinforcing material of an adjacent second layer. In some embodiments, reinforcing material of a first layer may be perpendicular to reinforcing material of an adjacent second layer. In some embodiments, reinforcing material of a first layer may be oriented at a first angle to reinforcing material of an adjacent second layer, and the first angle may range from 0° to 90°, for example 45°. Reinforcing material of a third layer may be oriented at a second angle to reinforcing material of the second layer, and the second angle may range from 0° to 90°, for example 45°. In some embodiments, the second angle may comprise a negative value, such as −45°. In some embodiments, the first angle and the second angle may have equal but opposite values.

Core layers 32 may be built-up to achieve any suitable desired bow limb profile. Core layers 32 may extend the full length of the bow limb 10 or may extend over a portion of length in order to create a varying limb thickness. Desirably, at least one full length layer 33 may be used at the top and bottom of the core layers 32 to cover any discontinuities. Core layers 32 may have any suitable reinforcing material orientation, such as unidirectional or bias-ply.

The compression side cover layers 43 may then be built-up on the compression side 42 of the bow limb 10, preferably to a thickness of at least 0.03 inches. Compression side cover layers 43 may have any suitable reinforcing material orientation, such as unidirectional or bias-ply. It should be noted that although the compression side 42 of the bow limb 10 generally experiences compression, it can also experience tension, for example when a bow string is released. Therefore, it is also desirable for the compression side cover layers 43 to have unidirectional reinforcing material oriented substantially parallel to a lengthwise axis of the bow limb 10 which extends the entire length of the bow limb 10. In some embodiments, the reinforcing fibers may be oriented as described with respect to the reinforcing fibers used on the tension side 40 of the bow limb 10.

An embodiment of a built-up bow limb precursor 11 prior to molding is shown in FIG. 3. Desirably during molding the precursor 11 may be heated until the thermoplastic material of the individual layers become united or consolidated into a single bow limb billet 15 (see FIG. 4), for example at or above the melting or fusion temperature of the thermoplastic material. In some embodiments, the precursor 11 may be heated in an oven and then transferred to a platen press to be formed under pressure. In some embodiments, a precursor 11 may be compression molded in a heated forming press. In some embodiments, a molding process may comprise heating a bow limb precursor 11 to temperatures ranging from 400-550° F. under pressures of 200-300 psi, with forming times of 8-12 minutes. The exact temperature, pressure and time will vary depending on the specific materials used and the specific size and shape of the bow limb.

After cooling, the bow limb billet 15 may comprise a single block of thermoplastic material impregnated with various layers of reinforcing material. In preferred embodiments, the bow limb billet 15 may comprise a tension side cover layer 41 and a compression side cover layer 43, each being at least 0.03 inches thick and having multiple layers of continuous lengthwise fibers extending the entire length of the bow limb billet 15.

Figure 5:
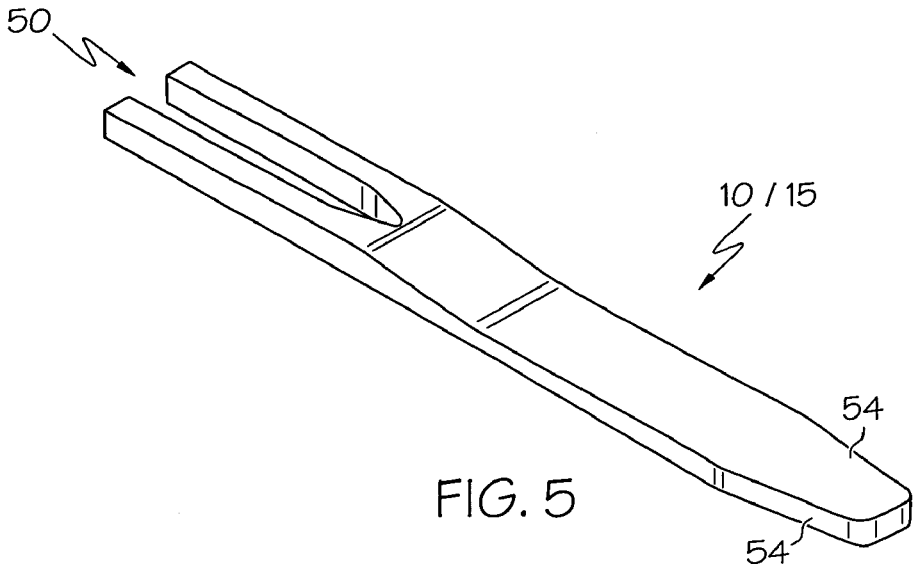
FIGS. 5-7 show the bow limb billet during stages of shaping to produce a bow limb.

Referring to FIG. 5, the bow limb billet 15 may be shaped using any suitable method or process. For example, a limb tip slot 50 and any desired shaping or profiling, such as contoured edges 54, may be machined into the bow limb billet 15. In some embodiments, contoured edges 54 may be shaped to allow the bow limb 10 to be received by specific embodiments of mounting cups 8 (see FIG. 1).

Figure 6:
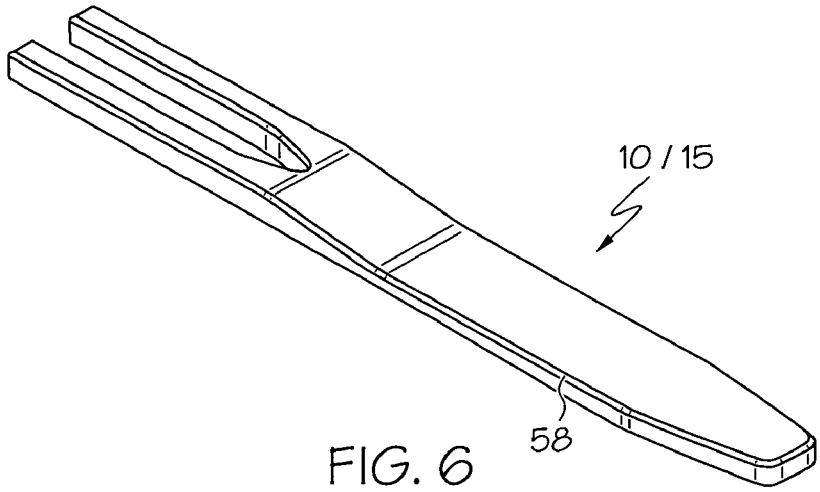

In some embodiments, outer edges and corners of the bow limb billet 15 may be rounded 58, for example as shown in FIG. 6. Rounded edges 58 may be formed using any suitable method.

In a preferred embodiment, the billet 15 may optionally be finish molded, for example in a second molding step under heat and pressure, to soften at least the outer surfaces of the billet. A finish molding step will desirably cover and seal any reinforcing fibers that may have become exposed during shaping and profiling operations.

In some embodiments, the dies that are used during a finish molding step may include radiused edges that may be used to form rounded edges 58 on the billet 15. Thus, rather than using a separate machining step, rounded edges 58 may be formed on the billet 15 during a second or finish molding step.

Referring to FIG. 7, axle holes 64 and a bolt slot or hole 60 may be formed in the bow limb 10. A bolt slot or hole 60 may receive a limb bolt 6 (see FIG. 1). In some embodiments, the axle holes 64 and the bolt hole 60 are not made until after any finish molding operation is performed.

In some embodiments, additional components may be attached to a bow limb 10 as desired. Any suitable components, such as limb pivot pads or blocks, limb axle pillow blocks, special reinforcements, etc., may be attached to a bow limb 10 at any suitable location using any suitable method, such as adhesives, thermal bonding, etc.

FIG. 7 shows an embodiment of a pivot pad 70. A pivot pad 70 or block may be located at a fulcrum of the bow limb 10 and may span the width of the bow limb 10. A pivot pad 70 may comprise any suitable shape and may function to distribute loading across an area of the bow limb 10, such as an area of the compression side of the limb 10. A pivot pad 70 may abut a portion of a bow, such as a handle 7 or mounting cups 8 (see FIG. 1).

Also shown is an embodiment of pillow blocks 72, which may house bearings that support ends of a shaft, such as an axle 14 (see FIG. 1). Pillow blocks 72 may be attached to a tension side of a bow limb 10.

In some embodiments, any of the additional components described above may comprise a thermoplastic material, for example being formed by injection molding, and may be united or consolidated with the bow limb 10. In some embodiments, additional components may be attached during a molding or finish molding process, and thus the dies used in the molding may be shaped accordingly. In some embodiments, additional components may be attached by other suitable processes that consolidate or unite the additional component and the bow limb 10, for example by sonic welding.

In some embodiments, a bow limb 10 may further be painted or otherwise coated for protection and/or appearance purposes. The completed bow limb 10 may then be assembled with other parts to form a bow 5.

Figure 4:
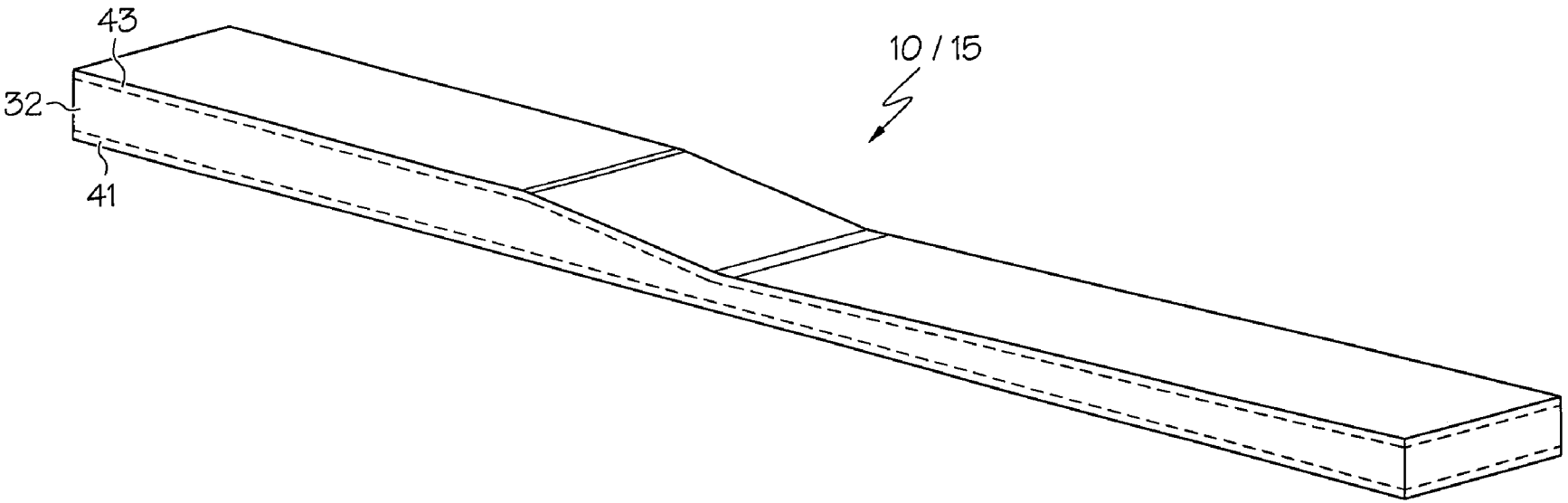
FIG. 4 shows an embodiment of a bow limb billet.
Figure 8:
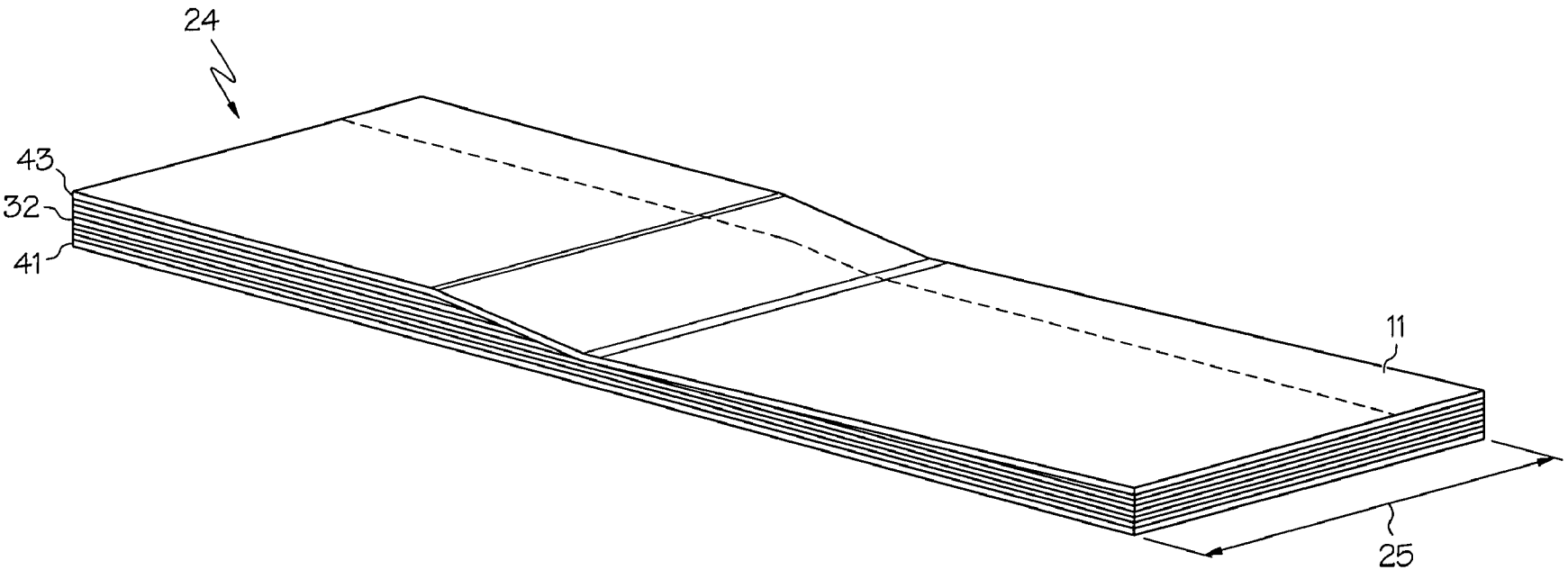
FIG. 8 shows an embodiment of a sheet precursor which may be molded and cut to make a plurality of bow limb billets.

FIG. 8 shows an embodiment of a plate or sheet precursor 24 that may be used to form a plurality of limb billets 15 (see FIG. 4). Layers of thermoplastic prepreg material may be built-up to form the sheet precursor 24, which may include tension side cover layers 41, core layers 32 and second or compression side cover layers 43. The sheet precursor 24 may have any suitable combination of layers of prepreg materials and may be built-up similar to a bow limb precursor 11 (see FIG. 3), but may have a greater width dimension than a bow limb precursor 11.

The sheet precursor 24 may be placed into a mold or die, wherein heat and pressure may be applied. Desirably the sheet precursor 24 may be heated until the thermoplastic material of the individual layers become united or consolidated into a single billet sheet, for example at or above the melting or fusion temperature of the thermoplastic material. After cooling, the billet sheet may be cut to form a plurality of bow limb billets 15, for example as shown in FIG. 4.

Figure 9:
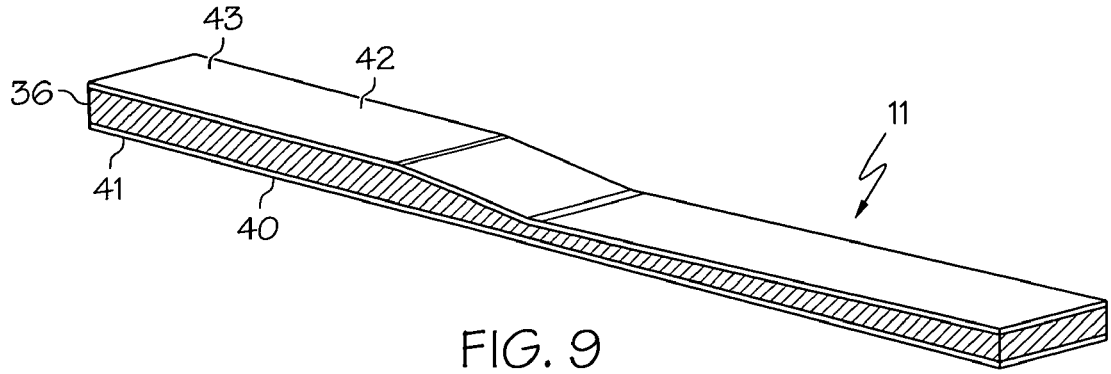
FIG. 9 shows an embodiment of a bow limb precursor comprising a core of material and layers of prepreg material.

FIG. 9 shows another embodiment of a bow limb precursor 11, which may comprise a core 36, a tension cover layer 41 and a compression cover layer 43.

Tensile and compressive forces in a bow limb may be the largest at the outer sides 40, 42 of the limb, and may reduce to zero at a neutral axis that will generally be located in the core 36, and may be located equidistant from the outer sides 40, 42 along a height dimension of the bow limb. The strength required from the bow limb materials grows from a minimum at the neutral axis to a maximum at the outer sides 40, 42 of the limb. Therefore, material used in the core 36 is generally not required to be as strong in tension and compression as the material used in the cover layers 41, 43.

In some embodiments, the core 36 may be made from one or more pieces of any suitable thermoplastic material capable of consolidating with the thermoplastic material of the prepregs used in the cover layers 41, 43. Preferably, the thermoplastic material used in the core 36 is the same as the thermoplastic material of the prepregs used in the cover layers 41, 43.

In some embodiments, the core 36 may consist of a thermoplastic material. In some embodiments, the core 36 may comprise a composite thermoplastic material having reinforcing, such as fiber reinforcing. In some embodiments, the core may comprise a thermoplastic material having long or short fiber reinforcing material in any suitable quantity, such as comprising 20%-65% reinforcing material by weight. The long or short fiber reinforcing material may be any suitable length and may be comparatively short when compared to the reinforcing material of the prepreg layers. For example, the reinforcing fiber of the core my have lengths equal to or less than 1 inch, ½ inch, ⅜ inch, ¼ inch 1/16 inch, etc. The amount of reinforcing required depends upon the strength required from the core 36, which depends upon the exact application of the bow limb and the bounds of the core 36 within the bow limb.

In some embodiments, the core 36 may comprise one or more pieces of injection molded thermoplastic material, which may further comprise reinforcing fibers. In some embodiments, core 36 pieces may be made to a desired shape using the materials and processes disclosed in U.S. Pat. No. 5,534,213, the entire disclosure of which is hereby incorporated herein by reference.

As shown in FIG. 9, layers of prepreg materials may be built up around the core 36 to form cover layers 41, 43 as described herein. The limb precursor 11 may then be molded as described herein to form a bow limb billet 15, such as shown in FIG. 4.

Figure 10:
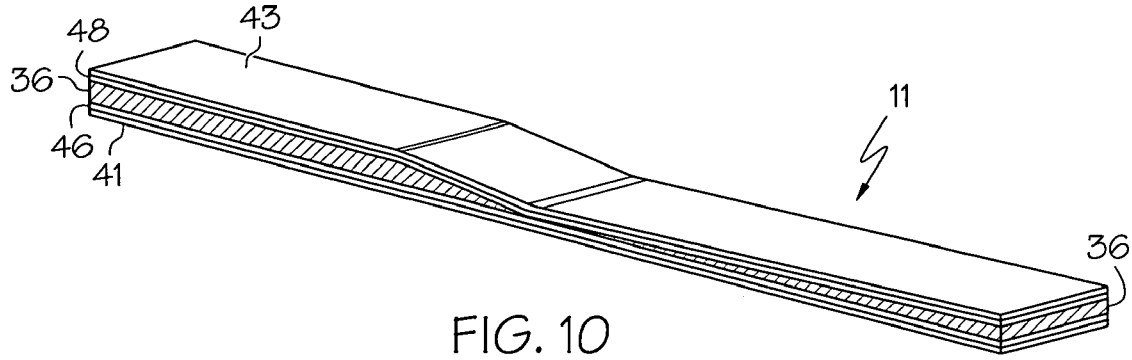
FIG. 10 shows another embodiment of a bow limb precursor comprising a core of material and layers of prepreg material.

FIG. 10 shows another embodiment of a bow limb precursor 11 wherein layers of prepreg materials are built up around core 36 pieces. The precursor 11 may comprise one or more intermediate tension layers 46 of prepreg materials and one or more intermediate compression layers 48 of prepreg materials. The intermediate layers 46, 48 may have any suitable reinforcing material orientation, such as unidirectional, woven or bias-ply. Cover layers 41, 43 may be built-up as described herein and preferably comprise a thickness of at least 0.03" of prepreg material having unidirectional reinforcing fibers that extend continuously over substantially the entire length of the precursor 11. The limb precursor 11 may then be molded as described herein to form a bow limb billet 15, such as shown in FIG. 4.

Figure 11:
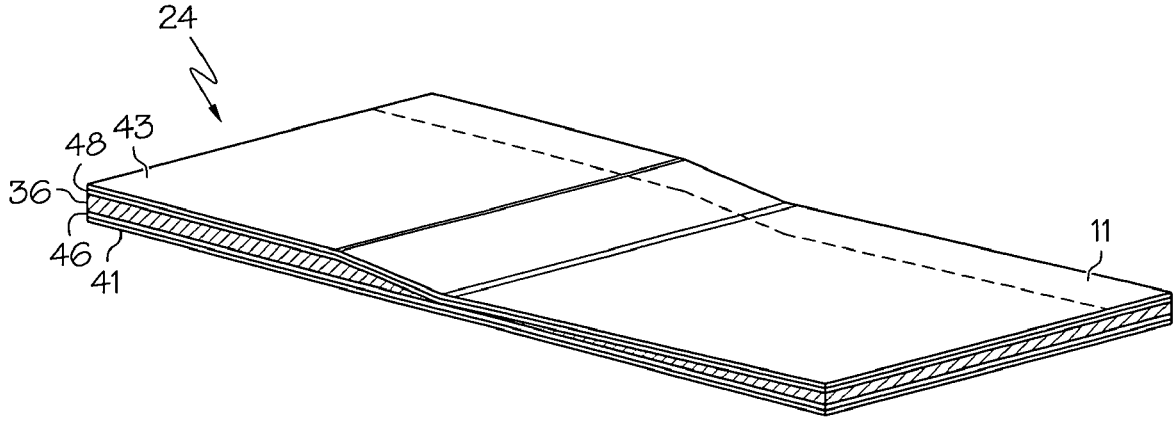
FIG. 11 shows an embodiment of a sheet precursor comprising a core of material and layers of prepreg material which may be molded and cut to make a plurality of bow limb billets.

FIG. 11 shows another embodiment of a sheet precursor 24 that may be used to form a plurality of limb billets 15. Layers of thermoplastic prepreg material 41, 46, 48, 43 may be built-up around one or more pieces of core 36 material to form the sheet precursor 24. The sheet precursor may be molded as herein described, and then cut to form a plurality of bow limb billets 15.

Embodiments of bow limbs 10 made using a core 36 comprising an injection molded thermoplastic material provide the benefit of a relatively inexpensive core 36 that is bonded to or consolidated with high strength outer surface layers 41, 43, creating a bow limb 10 that is capable of withstanding the high forces present in high performance archery bows.

Figure 12:
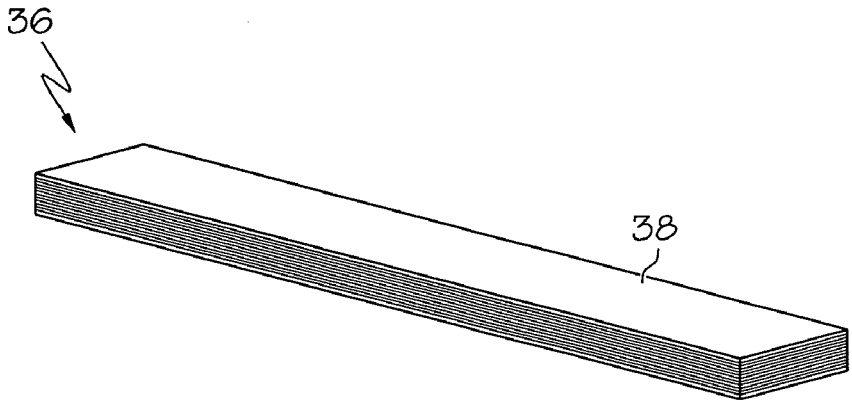
FIGS. 12 and 13 show embodiments of core material comprising a plurality of prepreg layers.
Figure 13:
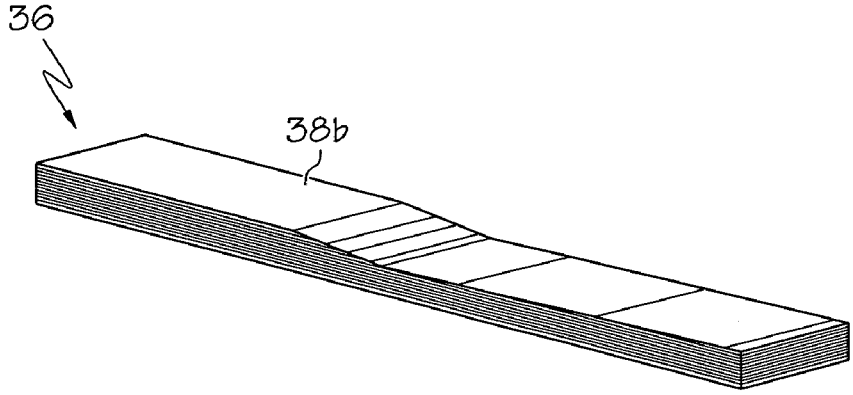
Figure 14:
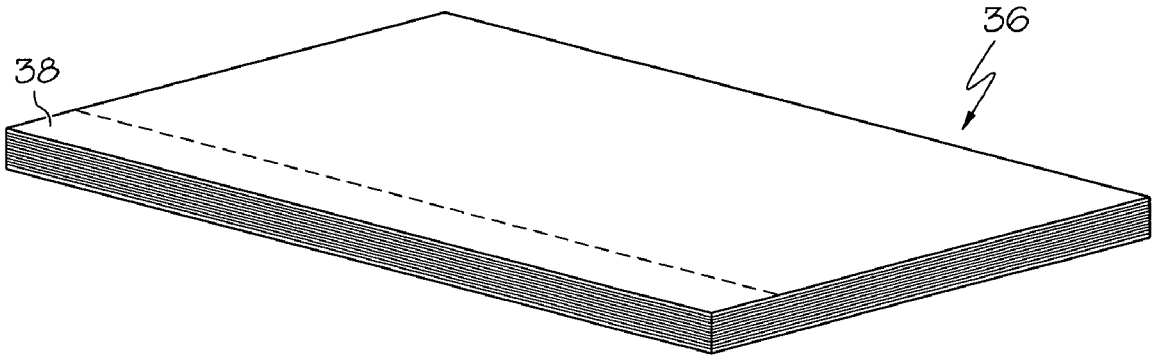
FIG. 14 shows an embodiment of a core precursor comprising a plurality of prepreg layers which may be molded and cut to make a plurality of core billets.

Referring to FIGS. 12-14, in some embodiments, pieces of core 36 material may be formed by molding various layers of prepreg materials to form core stock billets 38, which may have any suitable size, shape and reinforcing material composition. In some embodiments, shaped core stock billets **38*b* may be formed, either by using suitable built-up layers of prepreg materials or by performing shaping operation on non-shaped core stock billets 38. In some embodiments, sheets 39 of core stock billets 38 may be molded, which may then be cut to form individual core stock billets 38, or may be used to form sheet precursors 24, for example as shown in FIG. 11**.

A benefit of the inventive thermoplastic bow limbs is the ability to remold or reshape a bow limb for any reason. For example, if a bow limb becomes fractured or otherwise damages, remolding the limb in its original finish mold will reshape the thermoplastic material back to the original condition. A remolded/refinished thermoplastic bow limb may provide substantially the same strength and performance as when first manufactured.

In some embodiments, the invention is directed to an archery bow limb as described in the following numbered paragraphs.

1. An archery bow limb comprising:
   a body portion having a longitudinal axis, the body portion comprising a thermoplastic material, a tension layer of reinforcing fibers and a compression layer of reinforcing fibers, any portion of the bow limb having a component length, the component length being measured from a first edge to a second edge in a direction parallel to the longitudinal axis;
   wherein a continuous reinforcing fiber of the tension layer of reinforcing fibers extends at least 75% of the component length of the bow limb as measured in the area of the continuous reinforcing fiber.
2. The bow limb of paragraph 1, wherein the continuous reinforcing fiber extends at least 90% of the component length of the bow limb as measured in the area of the continuous reinforcing fiber.
3. The bow limb of paragraph 1, wherein a plurality of substantially parallel continuous reinforcing fibers of the tension layer of reinforcing fibers each extends at least 75% of the component length of the bow limb as measured in the area of each respective continuous reinforcing fiber.
4. The bow limb of paragraph 3, wherein the plurality of substantially parallel continuous reinforcing fibers extends across substantially an entire width dimension of the bow limb.
5. The bow limb of paragraph 3, wherein a plurality of substantially parallel continuous reinforcing fibers of the tension layer of reinforcing fibers each extends at least 90% the component length of the bow limb as measured in the area of each respective continuous reinforcing fiber.
6. The bow limb of paragraph 1, wherein the continuous reinforcing fiber is oriented in a tension side of the bow limb.
7. The bow limb of paragraph 1, wherein a second continuous reinforcing fiber of the compression layer of reinforcing fibers extends at least 75% of the component length of the bow limb as measured in the area of the second continuous reinforcing fiber.
8. The bow limb of paragraph 7, wherein the second continuous reinforcing fiber is oriented in a compression side of the bow limb.
9. The bow limb of paragraph 7, wherein a plurality of substantially parallel second continuous reinforcing fibers of the compression layer of reinforcing fibers each extends at least 75% of the component length of the bow limb as measured in the area of each respective second continuous reinforcing fiber.
10. The bow limb of paragraph 9, wherein the plurality of substantially parallel second continuous reinforcing fibers extends across substantially an entire width dimension of the bow limb.

11. The bow limb of paragraph 1, wherein the thermoplastic material comprises a material selected from a group consisting of: polyamide, polyphenylene sulfide, polyethylene, polyether imide, polyetheretherketone, polyethylene terephthalate, polyetherketone, perfluoroalkoxy, polypropylene, polymethylmethacrylate and polyoxymethylene.
12. The bow limb of paragraph 1, wherein the continuous reinforcing fiber comprises a material selected from a group consisting of: carbon fibers, Aramid fibers and fiberglass.
13. The bow limb of paragraph 1, further comprising a core of thermoplastic material.
14. The bow limb of paragraph 13, wherein the core further comprises reinforcing fibers having a length of ½ inch or less.
15. The bow limb of paragraph 1, wherein the body portion comprises a tension side cover layer of thermoplastic material at least 0.03 inches thick.
16. The bow limb of paragraph 17, wherein the body portion comprises a compression side cover layer of thermoplastic material at least 0.03 inches thick.
17. The bow limb of paragraph 1, wherein the bow limb does not comprise a thermoset material.

In some embodiments, the invention is directed to methods of making an archery bow limb as described in the following numbered paragraphs.

1. A method of making an archery bow limb comprising:
   providing a thermoplastic prepreg material;
   providing a core comprising thermoplastic material;
   creating a bow limb precursor by orienting a first layer of prepreg material over a side of the core; and
   heating the bow limb precursor to consolidate the thermoplastic of the prepreg with the thermoplastic of the core.
2. The method of paragraph 1, wherein the prepreg material comprises reinforcing material impregnated with a thermoplastic.
3. The method of paragraph 1, wherein the first layer of prepreg material comprising unidirectional reinforcing material oriented substantially parallel to a lengthwise axis of the bow limb precursor.
4. The method of paragraph 3, wherein the first layer of prepreg material comprises a plurality of layers of prepreg material, the plurality of layers having a thickness of at least 0.03 inches.
5. The method of paragraph 1, wherein the step of heating the bow limb precursor further comprises applying pressure to the bow limb precursor.
6. The method of paragraph 1, wherein the step of creating a bow limb precursor further comprises orienting a second layer of prepreg material over a second side of the core, the second layer of prepreg material oriented across the core from the first layer of prepreg material.
7. The method of paragraph 6, wherein the second layer of prepreg material comprises a plurality of layers of prepreg material, the plurality of layers having a thickness of at least 0.03 inches.
8. The method of paragraph 6, wherein the second layer of prepreg material comprises unidirectional reinforcing material oriented substantially parallel to a lengthwise axis of the bow limb precursor.
9. The method of paragraph 1, wherein the step of creating a bow limb precursor further comprises orienting an intermediate layer of prepreg material between the core and the first layer of prepreg material.
10. The method of paragraph 9, wherein the intermediate layer comprises first reinforcing fibers that are substantially parallel to one another and nonparallel to the reinforcing fibers of the first layer of prepreg material.
11. The method of paragraph 10, wherein the intermediate layer further comprises second reinforcing fibers that are substantially parallel to one another and nonparallel to the first reinforcing fibers.
12. The method of paragraph 1, wherein the step of providing a core further comprises injection molding a thermoplastic material to form the core.
13. The method of paragraph 1, wherein the step of providing a core further comprises arranging a plurality of layers of prepreg material to form the core.
14. The method of paragraph 1, further comprising cutting the bow limb to a predetermined shape.
15. The method of paragraph 14, further comprising a finish molding step wherein the bow limb is heated under pressure.
16. The method of paragraph 15, wherein an edge of the bow limb is rounded during the finish molding step.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow limb comprising:
   a tension side layer, a core layer and a compression side layer;
   each layer comprising a thermoplastic material;
   wherein the tension side layer further comprises a plurality of reinforcing fibers, the reinforcing fibers oriented substantially parallel to a lengthwise axis of the bow limb and continuously spanning a substantial length of the bow limb;
   the bow limb further comprising an intermediate layer having first reinforcing fibers that are substantially parallel to one another and nonparallel to the reinforcing fibers of the tension side layer.

2. The bow limb of claim 1, wherein the compression side layer further comprises a plurality of reinforcing fibers, the reinforcing fibers oriented substantially parallel to a lengthwise axis of the bow limb and continuously spanning a substantial length of the bow limb.

3. The bow limb of claim 1, wherein the core layer further comprises a plurality of short reinforcing fibers suspended throughout the core layer.

4. The bow limb of claim 1, wherein the intermediate layer further comprises second reinforcing fibers that are substantially parallel to one another and nonparallel to the first reinforcing fibers.

5. The bow limb of claim 4, wherein the first reinforcing fibers of the intermediate layer are oriented at a predetermined positive angle to the reinforcing fibers of the tension side layer, the second reinforcing fibers of the intermediate layer are oriented at a predetermined negative angle to the reinforcing fibers of the tension side layer, an absolute value of the positive angle being equal to an absolute value of the negative angle.

6. The bow limb of claim 1, wherein the intermediate layer is located between the core layer and the tension side layer.

7. The bow limb of claim 1, wherein the intermediate layer is located between the core layer and the compression side layer.

8. The bow limb of claim 1, wherein the tension side layer is at least 0.03 inches thick.

9. The bow limb of claim 8, wherein the compression side layer is at least 0.03 inches thick.

10. The bow limb of claim 1, wherein the bow limb does not comprise a thermoset material.

* * * * *